US005222766A

United States Patent [19]

Instance

[11] Patent Number: 5,222,766

[45] Date of Patent: Jun. 29, 1993

[54] LABELS AND MANUFACTURE THEREOF

[76] Inventor: David J. Instance, Guinea Hall, Sellindge, Kent TN25 6EG, United Kingdom

[21] Appl. No.: 651,216

[22] PCT Filed: Aug. 15, 1989

[86] PCT No.: PCT/GB89/00954

§ 371 Date: Feb. 4, 1991

§ 102(e) Date: Feb. 4, 1991

[87] PCT Pub. No.: WO90/02395

PCT Pub. Date: Mar. 8, 1990

[30] Foreign Application Priority Data

Aug. 16, 1988 [GB] United Kingdom ..... 8819429

[51] Int. Cl.[5] ..... B42D 15/00

[52] U.S. Cl. ..... 283/81; 428/42; 40/630

[58] Field of Search ..... 283/81, 100, 101; 40/299, 630; 428/40–43

[56] References Cited

FOREIGN PATENT DOCUMENTS 130053 2/1985 European Pat. Off. .
2191453 12/1987 United Kingdom .
2197293 5/1988 United Kingdom .

*Primary Examiner*—Mark Rosenbaum
*Assistant Examiner*—Willmon Fridie, Jr.
*Attorney, Agent, or Firm*—Hill, Steadman & Simpson

[57] ABSTRACT

A label for attachment to a container, the label comprising a longitudinal strip which is divided into a series of at least three panels by at least two transverse fold lines, the strip being folded about the transverse fold lines such that one panel forms a front cover for the label and adjacent second and third panels at opposing ends of the front cover are folded about respective transverse fold lines behind the front cover and both form a rear surface of the folded longitudinal strip; and a support piece to which the rear surface of the folded longitudinal strip is attached, the support piece being coated with a release material whereby the rear surface of the longitudinal strip is releasably adhered to the release material such that at least one of the first and second panels can be detached from the support piece to open the label.

12 Claims, 1 Drawing Sheet

LABELS AND MANUFACTURE THEREOF

The present invention relates to a label, and in particular, to a folded label to be attached to a container such as a bottle, can, packet or the like. The present invention also relates to a method of producing labels.

A known folded label is described in my U.K. Publication No. 2191463. That application discloses a label for attachment to a container, the label comprising a longitudinal strip which is divided into a series of panels by a plurality of transverse fold lines, the strip being folded about the transverse fold lines so that one end of the panel and the adjacent panel form rear and front cover panels, respectively, which envelope the remaining panel or panels of the folded strip, the rear cover panel of the strip being shorter in the longitudinal direction than at least the front cover panel and a third panel, which is adjacent to the front panel, extending beyond the free end of the rear cover panel and having a rearwardly directed overlapping portion; and a support web to which is adhered the rear surface of the rear cover panel, the overlapping portion being releasably adhered to the support web so as to maintain the folded label in a closed configuration, the arrangement being such that the label can be opened by detaching the overlapping portion from the support web. Such a label described in that application suffers from the disadvantage that the requirement for an overlapping portion limits the size of the inside panels of the label. Also, the support web needs to be larger than the rear cover panel to allow the flap to be adhered thereto U.K 2191463 also discloses that a layer of release material may be applied to the overlapping portion of the folded longitudinal strip, so as to improve the effectiveness with which the label can be repeatedly resealed. This makes the manufacture of a length of release backing material carrying a succession of folded labels unnecessarily complicated since the release material must be applied in discrete steps.

It is an aim of the present invention to provide a label which makes effective use of the area of the longitudinal strip.

Accordingly the present invention provides a label for attachment to a container, the label comprising a longitudinal strip which is divided into a series of at least three panels by at least two transverse fold lines, the strip being folded about the transverse fold lines such that one panel forms a front cover for the label and second and third panels at opposing ends of the front cover are folded about respective transverse fold lines behind the front cover and together form a rear surface of the folded strip: and a support piece to which the rear surface of the folded strip is attached, at least a part of the rear surface of the folded strip being releasably adhered to the support piece such that at least one of the second and third panels can be detached from the support piece to open the label, characterised in that the rear surface is comprised of substantially equal areas of the second and third panels.

The present invention also provides a method of producing a succession of labels carried on a length of release backing material, the method comprising the steps of:

a) providing a length of a laminar web comprising a self-adhesive support web, which is releasably adhered to a length of a release backing material;

b) adhering a succession of folded longitudinal strips to the front surface of the support web, each longitudinal strip being divided into a series of at least three panels by at least two transverse fold lines, the strip being folded about the transverse fold lines such that one panel forms a front cover of the label and second and third panels at opposing ends of the front cover are folded about respective transverse fold lines behind the front cover and both form a rear surface of the folded longitudinal strip, the rear surface being comprised of substantially equal areas of the second and third panels and at least a part of the rear surface being releasably adhered to the support web; and c) cutting a succession of support pieces from the support web thereby to form a succession of cut out labels carried on the release backing material, each cut out label including a respective folded longitudinal strip.

Embodiments of the present invention will now be described by way of example only with reference to the accompanying drawings in which.

Figure 1:
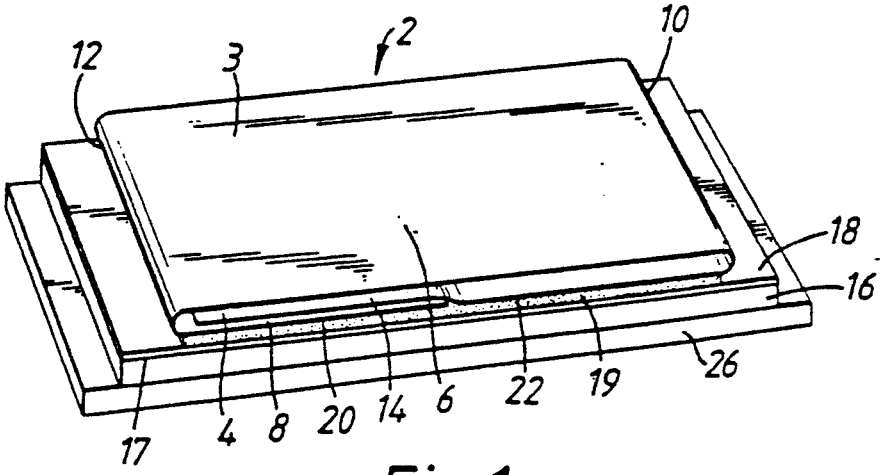
FIG. 1 is a perspective view of a folded label according to a first embodiment of the present invention when carried on a length of release backing material.

Referring to FIG. 1, a label 2 comprises a longitudinal sheet 3 e.g. of paper which is folded into a series of three panels 4, 6, 8 by a pair of transverse fold lines 10, 12. A middle panel 6 forms a front cover of the label 2, and second and third panels 4, 8 are at opposing ends of the front cover panel 6. The second panel 4 and the front cover panel 6 have substantially the same length in the longitudinal direction and are longer than the third panel 8. The second panel 4 is folded about the transverse fold line 10 between the second panel 4 and the front cover panel 6 so as to lie underneath the front cover panel 6, and the third panel 8 is folded about the other transverse fold line 12 between the front cover panel 6 and the third panel 8 so as to lie under the second panel 4. A portion 14 of the second panel 4 overlaps the third panel 8. Further panels (not shown) can be attached to the free end of the second panel 4 and folded between the second panel and the front cover panel 6. The folded strip with the further panels may be in the form of a flattened tube or the strip may have concertina-like folded panels. These further panels can also have substantially the same dimensions as the front cover panel. A support piece 16 has a front surface 17 coated with a release material 18. Typically the support piece 16 is of clear plastics, preferably acetate or polystyrene. Typically the release material 18 comprises an overprinting varnish or a mixture of polysiloxane and a varnish. Preferably, the mixture contains from 90 to 99.5 vol % polysiloxane such as a polysiloxane manufactured under the code name WS70M and WS78L by Wacker and sold in Great Britain by Ambersil Limited, Basingstoke, Hampshire as silicone fluid F100, and from 0.5 to 10 vol % varnish, such as an overprinting varnish made by Fishburn and having the code name XF 05546. The rear surface of the strip 2 comprises the rearwardly directed surface 20 of the third panel 8 and that part 22 of the rearwardly directed surface of the second panel 4 which is not covered by the third panel 8. The rear surface of the strip 2 is releasably adhered to the coated front surface of a respective support piece 16 by a water-soluble or pressure sensitive adhesive 19. The pressure sensitive adhesive 19 may be arranged in a continuous layer or in longitudinally directed strips. The support piece 16 is of the same width as the longitudinal strip 3 and extends beyond the transverse fold lines 10, 12 at the respective end of the folded longitudinal strip 3. The rear surface of the support piece 16 is coated with a pressure-sensitive adhesive so as to be self-adhesive and is releasably adhered to a release backing material 26, such as waxed paper. The support piece 16 may be adhered by the self-adhesive surface to a product to be labelled. Some or all of the surfaces of the strip 2 may be printed with e.g. textual information relating to the product to be labelled.

Figure 2:
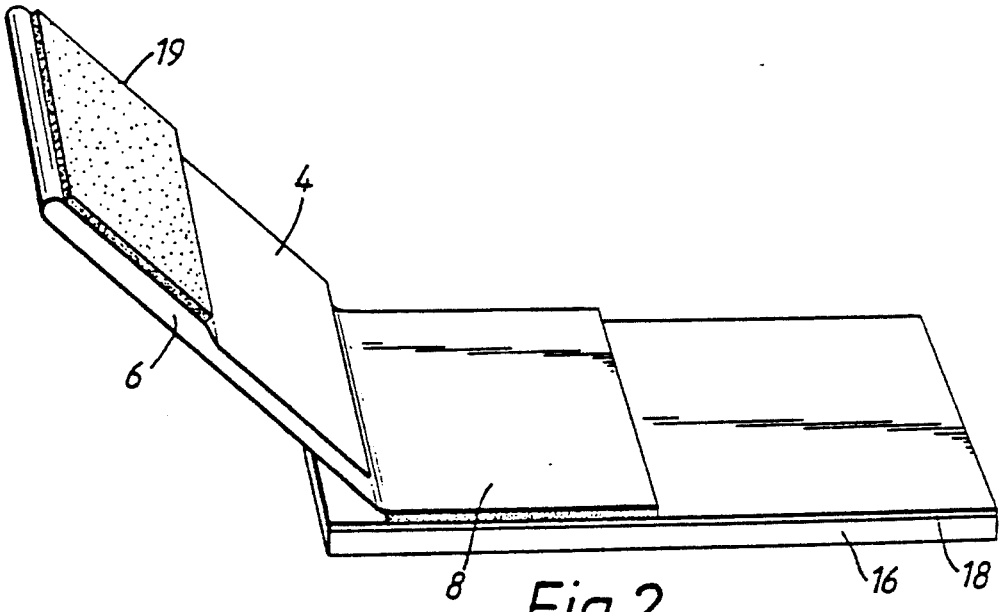
FIG. 2 is a perspective view of the folded label of FIG. 1 in a partially opened configuration.

Referring to FIG. 2, the label 2 may be opened by detaching the said rearwardly directed part 22 of the second panel 4 and the adhesive 19 adhered thereto from the release material 18, and unfolding the label about the fold lines 10 and 12 so as to expose the previously hidden surfaces of the three panels 4, 6, 8. The label 2 can be completely removed from the support piece 16 by detaching the third panel 8 from the release material 18. The release material acts to seal the surface of the support piece so that the adhesive dries into the folded strip. Then when the strip is pulled away from the support piece the strip retains the adhesive thereon and no adhesive remains on the sealed surface of the support piece. Thus the support piece is free of adhesive and the rear surface of the strip is coated with a coherent, non-tacky adhesive layer. The label 2 can also be reattached to the support piece 16 by replacing adhesive layer 19 on the third panel 8 against the release material 18, and resealed by folding the label 2 along fold lines 12 and 10 and replacing the adhesive layer 19 on the second panel 4 against the release material 18.

Figure 3:
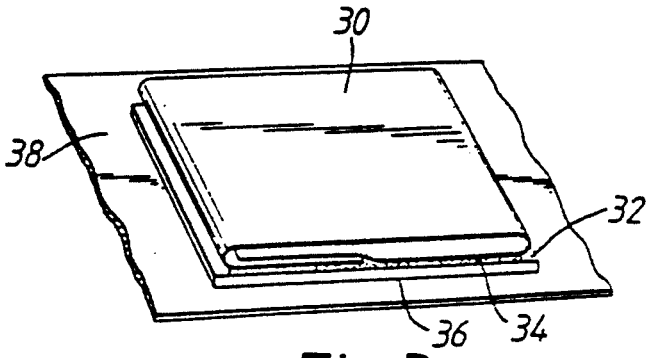
FIG. 3 is a perspective view of a folded label according to a second embodiment of the present invention when carried on a length of release backing material.

Referring to FIG. 3, there is shown a second embodiment of a label in accordance with the present invention. The label of the second embodiment is similar to that of the first embodiment, except that the second embodiment omits the layer of release material and employs specific interrelated materials for the longitudinal strip, the support piece and the adhesive to ensure releasable adhesion of the strip onto the support piece.

As shown in FIG. 3, the folded longitudinal strip 30, which is composed of paper and has the same configuration as that of the longitudinal strip of the first embodiment, is adhered to a support piece 32 by means of a layer 34 of water-soluble adhesive. The support piece 32 is composed of a plastics material, preferably acetate. The rear surface 36 of the support piece 32 is coated with pressure-sensitive adhesive so as to be self-adhesive and is carried on a length of release backing material 38 such as waxed paper. As in the first embodiment, the rear surface 40 of the folded strip 30 can be pulled away from the support piece 32 thereby to access the interior of the folded strip 30.

The specific combination of acetate for the support piece 32, paper for the longitudinal strip 30 and a water-soluble adhesive for the layer 34 provides specific advantages. First, acetate is relatively stiff and so a web of the acetate layer is relatively easy to feed in a continuous manner during application of the labels to containers or products to be labelled by means of an automatic high-speed labelling machine. Furthermore, acetate readily accepts the application thereto of a water-soluble adhesive, i.e. acetate is not hydrophobic and accordingly a coherent layer of water-soluble adhesive can readily be applied over the acetate. However, the acetate does not absorb the water-soluble adhesive. Consequently, when the longitudinal strip of paper is applied over the adhesive, the adhesive dries into the paper. The resultant effect is that when the longitudinal strip is pulled away from the support piece, the rear surface of the strip is coated with a coherent, non-tacky layer of dried water-soluble adhesive. The adhesive is stripped cleanly away from the support piece. This has the great advantage that the support piece, which may be printed, is still useful as a labelling surface since it is clean, unmasked, and free of residual adhesive and that the removed strip has convenient dry surfaces.

In a further embodiment of the present invention a layer of release material is applied over only a portion of the upper surface of the support piece whereby a part of the rear surface of the strip is permanently adhered to the support piece over a second portion of the support piece which is not coated with the release material. For example, in the embodiment of FIGS. 1 and 2, the rearwardly directed surface 20 of the third panel 8 can be directly and permanently adhered to the support piece 16 by omission thereunder of the release material 18.

A succession of labels, the labels being labels as described above, may be releasably adhered to a strip of release backing material, so as to allow the labels to be adhered to respective containers by a continuous process.

A method for producing a succession of the labels of the present invention on a length of release backing material will now be described.

A length of a laminar web, which comprises a self-adhesive support web e.g. of plastic such as clear acetate, releasably adhered to a length of release backing material 26 e.g. coated paper is provided. The front surface of the self-adhesive support web is coated with a layer of release material 18 such as the polysiloxane varnish composition described above. A succession of longitudinal strips of paper 3 are each folded along two transverse fold lines 10, 12 to form three panels 4, 6, 8 as described above. The third panel 8 and the uncovered part of the second panel 4 of each folded longitudinal strip 3 are releasably adhered to the coated front surface of the self-adhesive support web by adhesive 19. Preferably the adhesive 19 is pressure sensitive adhesive. The release material 18 and self-adhesive support web are die cut parallel to, and beyond each end of each folded longitudinal strip 3 so as to form a support piece 16 under each folded longitudinal strip 3, each support piece 16 being coated with release material 18. The edges of the laminar web and the longitudinal strips 3 are die cut to a required width. The unwanted strips of the self-adhesive support web formed between the support pieces 16 are then removed, together with the unwanted edge trimmings of the support web, so as to leave a succession of folded labels 2 carried on length of release backing material 26. The folded labels have the construction shown in FIG. 1. If desired, the method may omit the release material when it is desired to manufacture labels of the construction shown in FIG. 3.

With the present invention, since the rear surface of the second panel is releasably adhered to the support piece, the overall dimensions of the second panel, and any remaining panels attached thereto, can be substantially the same as that of the front cover panel. This optimises the provision of labelling area. Also, the support piece can be substantially the same size as the majority of the panels in the label.

The preferred embodiments of the present invention can provide a folded label, the whole of one surface of which can be used to display information. Further, the folded label according to the present invention can have a total area which is not restricted by the area of the label which is adhered to the article carrying the labels.

The preferred embodiments of the present invention can further provide a method of producing a succession of folded labels carried on a length of release backing material which method is made simple by the application of a release material in a continuous layer.

I claim:

1. A label for attachment to a container, the label comprising a longitudinal strip which is divided into a series of at least three panels by at least two transverse fold lines, the strip being folded about the transverse fold lines such that one panel forms a front cover for the label and second and third panels at opposing ends of the front cover are folded about respective transverse fold lines behind the front cover and together form a rear surface of the folded strip; and a support piece to which the rear surface of the folded strip is attached, at least a part of the rear surface of the folded strip being releasably adhered to the support piece such that at least one of the second and third panels can be detached from the support piece to open the label, characterised in that the rear surface is comprised of substantially equal areas of the second and third panels.

2. A label according to claim 1 wherein the support piece is composed of a plastics material, the longitudinal strip comprises paper and the longitudinal strip is adhered to the support piece by a water-soluble adhesive.

3. A label according to claim 2 wherein the plastics material is composed of acetate.

4. A label according to claim 1 wherein the support piece is coated with a release material.

5. A label according to claim 4 wherein the release material contains from 90 to 99.5 vol % polysiloxane and from 0.5 to 10 vol % varnish.

6. A label according to any of claims 1–5, wherein the support piece has a rear face and the rear face of the support piece is coated with a pressure-sensitive adhesive.

7. A length of release backing material carrying a succession of labels, the labels being as claimed in claim 6, each label being adhered to the length of release backing material by the respective pressure-sensitive adhesive on the respective piece.

8. A method of producing a succession of labels carried on a length of release backing material, the method comprising the steps of:

a) providing a length of a laminar web comprising a self-adhesive support web, which is releasably adhered to a length of a release backing material;

b) adhering a succession of folded longitudinal strips to the front surface of the support web, each longitudinal strip being divided into a series of at least three panels by at least two transverse fold lines, the strip being folded about the transverse fold lines such that one panel forms a front cover of the label and second and third panels at opposing ends of the front cover are folded about respective transverse fold lines behind the front cover and both form a rear surface of the folded longitudinal strip the rear surface being comprised of substantially equal areas of the second and third panels and at least a part of the rear surface being releasably adhered to the support web; and c) cutting a succession of support pieces from the support web thereby to form a succession of cut out labels carried on the release backing material, each cut out label including a respective folded longitudinal strip.

9. A method according to claim 8 wherein the support web is composed of a plastics material, the longitudinal strip comprises paper and in step (b) the strips are adhered by means of a water-soluble adhesive.

10. A method according to claim 9 wherein the plastics material is composed of acetate.

11. A method according to claim 8 further comprising the step between steps (a) and (b), of coating a front surface of the support web with a release material.

12. A method according to claim 11, wherein the release material contains from 90 to 99.5 vol % polysiloxane and from 0.5 to 10 vol % varnish.

* * * * *